US007867684B2

(12) United States Patent
Watanabe et al.

(10) Patent No.: US 7,867,684 B2
(45) Date of Patent: Jan. 11, 2011

(54) LIQUID DEVELOPER, PROCESS CARTRIDGE, AND IMAGE FORMING APPARATUS

(75) Inventors: Yasuaki Watanabe, Kanagawa (JP); Ryosaku Igarashi, Kanagawa (JP); Keitaro Mori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 120 days.

(21) Appl. No.: 12/353,445

(22) Filed: Jan. 14, 2009

(65) Prior Publication Data

US 2009/0274973 A1 Nov. 5, 2009

(30) Foreign Application Priority Data

Apr. 30, 2008 (JP) ..... 2008-119043

(51) Int. Cl.
*G03G 9/00* (2006.01)

(52) U.S. Cl. ..... 430/115; 430/112; 430/114

(58) Field of Classification Search ..... 430/115, 430/112, 114

See application file for complete search history.

(56) References Cited

U.S. PATENT DOCUMENTS

| | | | | |
|---|---|---|---|---|
| 4,323,929 | A | 4/1982 | Nacci | |
| 5,567,564 | A * | 10/1996 | Ziolo | 430/115 |
| 2009/0245873 | A1 * | 10/2009 | Teshima et al. | 399/237 |

FOREIGN PATENT DOCUMENTS

| | | |
|---|---|---|
| JP | 63-042262 | 8/1988 |
| JP | 3-075864 | 12/1991 |
| JP | 5-188827 | 7/1993 |
| JP | 5-87834 | 12/1993 |
| JP | 6-4008 | 1/1994 |
| JP | 9-156150 | 6/1997 |

* cited by examiner

*Primary Examiner*—Hoa V Le
(74) *Attorney, Agent, or Firm*—Fildes & Outland, P.C.

(57) ABSTRACT

A liquid developer includes: an aqueous medium; and a magnetic toner which is substantially dispersed in the aqueous medium and includes a polymer compound and a magnetic powder, the amount of the magnetic powder being from about 0.2 volume % to about 5 volume % with respect to the magnetic toner.

16 Claims, 2 Drawing Sheets

LIQUID DEVELOPER, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2008-119043 filed on Apr. 30, 2008.

BACKGROUND

1. Technical Field

The present invention relates to a liquid developer, a process cartridge, and an image forming apparatus.

2. Related Art

A magnetic copying machine that prints a desired number of copies by forming a latent image only once is known. In the magnetic copying machine, printing is performed as follows: a magnetic latent image is magnetically formed and held on a magnetic recording medium (magnetic latent image holder); magnetic toner is supplied to the magnetic recording medium so as to visualize the magnetic latent image as a toner image in a development area; a recording medium such as paper is pressed onto the magnetic recording medium so that the visualized toner image is transferred to the recording medium in a transfer area; and, subsequently, the recording medium is conveyed to a fixing area, and the toner image is fixed on the recording medium.

SUMMARY

According to an aspect of the invention, there is provided a liquid developer including an aqueous medium; and a magnetic toner which is substantially dispersed in the aqueous medium and includes a polymer compound and a magnetic powder, the amount of the magnetic powder being from about 0.2 volume % to about 5 volume % with respect to the magnetic toner.

BRIEF DESCRIPTION OF THE DRAWINGS

Exemplary embodiments of the present invention will be described in detail based on the following drawings, wherein.

DETAILED DESCRIPTION

Figure 1:
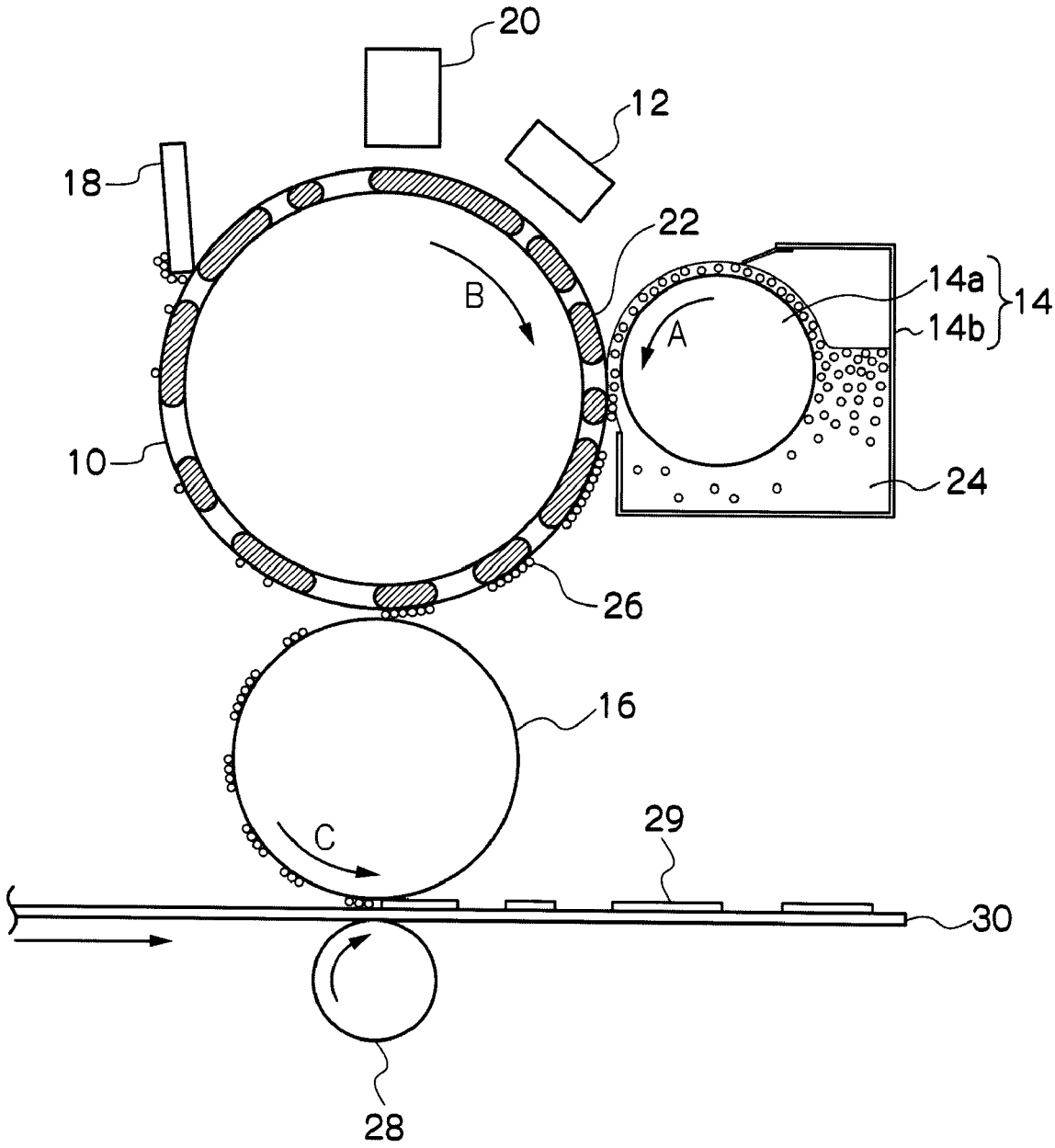
FIG. 1 is a schematic configuration diagram illustrating an example of an image forming apparatus according to an exemplary embodiment of the present invention.

Hereinafter, exemplary embodiments of the present invention will be described in detail.

Liquid Developer

A liquid developer according to an exemplary embodiment of the present invention includes an aqueous medium and a magnetic toner, the magnetic toner being substantially dispersed in the aqueous medium and including a polymer compound and a magnetic powder. The amount of the magnetic powder may be from 0.2 volume % to 5 volume % or from about 0.2 volume % to about 5 volume %, with respect to the magnetic toner.

In the liquid developer according to the exemplary embodiment of the present invention, the magnetic toner including a magnetic powder is dispersed in an aqueous dispersion medium, and the liquid developer may be used for development utilizing a magnetic field.

Hereinafter, each component of the liquid developer according to the present exemplary embodiment will be described in detail.

Magnetic Toner

A magnetic toner includes a polymer compound and a magnetic powder. The magnetic toner may include other additives as required.

Magnetic Powder

Examples of the magnetic powder include known magnetic powders. Among the known magnetic powders, an iron magnetic powder may be used. An iron magnetic powder has high magnetic force. Therefore, when an iron magnetic powder is used as the magnetic powder, magnetic permeability may further be improved, high magnetic flux density can be obtained even in a low magnetic field, and development properties may be improved. Preferable examples of the iron magnetic powder include magnetite and ferrite which are represented by a formula of $MO.Fe_2O_3$ or $M.Fe_2O_4$ and exhibit magnetism. In the formulae, M represents a divalent or monovalent metal ion or ions of a single metal or plural metals such as Mn, Fe, Ni, Co, Cu, Mg, Zn, Cd, or Li. Specific examples of the iron magnetic powder include iron oxides such as magnetite, γ ferric oxide, Mn—Zn ferrite, Ni—Zn ferrite, Mn—Mg ferrite, Li ferrite, or Cu—Zn ferrite. Among the above, as the iron magnetic powder, magnetite which is inexpensive and is pure iron is particularly preferable.

A magnetization of a magnetic powder in a magnetic field of 40 kA/m may be from $7.2\times10^{-4}$ ewb/m$^2$ to 0.0178 wb/m$^2$ or from about $7.2\times10^{-4}$ ewb/m$^2$ to about 0.0178 wb/m$^2$. When the magnetization is within the above range, higher magnetic permeability may be achieved, high magnetic flux density may be obtained even in a low magnetic field, and development properties may be improved.

Here, measurement of magnetic characteristics may be performed using a vibrating-sample magnetometer VSMP 10-15 (trade name, manufactured by Toei Kogyo Co., Ltd.). A cell having an inner diameter of 7 mm and a height of 5 mm is filled with a measurement sample, and then set in the magnetometer. In the measurement, a magnetic field is applied and then swept to 10 kOe (kilo-oersted) at a maximum. Then, the applied magnetic field is decreased to prepare a hysteresis curve. From data in the hysteresis curve, saturation magnetization is determined. Moreover, the magnetization at 1 kOe (kilo-oersted) is determined. In addition, residual magnetization and retentive power may also be determined from the hysteresis curve.

The surface of the magnetic powder may be subjected to hydrophobic treatment. The method of hydrophobic treatment is not limited, and the hydrophobic treatment may be carried out, for example, by covering the surface of a magnetic powder with a hydrophobing agent such as a coupling agent, silicone oil, or a resin. Among these, it is preferable to carry out surface coating treatment using a coupling agent.

The surface of a magnetic powder may often be hydrophilic. Thus, the hydrophobic treatment may improve compatibility of the magnetic powder with a hydrophobic monomer in a polymer compound, which will be described later, and improvement in compatibility of a hydrophilic monomer with a hydrophobic monomer in a polymer compound may provide a uniform dispersibility of the magnetic powder in a particle.

The amount of the magnetic powder may be from 0.2 volume % to 5 volume % or from about 0.2 volume % to about 5 volume %, with respect to the magnetic toner.

The amount of the magnetic powder is within the above range. Higher development properties may be achieved when at least one of the various properties (such as material, magnetization, etc., of the magnetic powder) is satisfied.

High Molecular Weight Compound

Examples of a polymer compound include resins which may be used for a magnetic recording apparatus in general. Specific examples thereof include: homo-polymer resins and copolymer resins of styrene and/or the substituted products thereof, a copolymer resin of styrene and (meth)acrylate; a multi-component copolymer resin of styrene, (meth)acrylic acid ester, and another vinyl monomer; a copolymer resin of styrene and another vinyl monomer; and a product which may be obtained by crosslinking any one of these resins. Furthermore, examples of the polymer compound include: polymethyl methacrylate, polybutyl methacrylate, polyvinyl acetate resin, a polyester resin, an epoxy resin, a polyamide resin, a polyolefin resin, a silicone resin, a polybutyral resin, a polyvinyl alcohol resin, a polyacrylic resin, a phenol resin, an aliphatic hydrocarbon resin, an alicyclic hydrocarbon resin, a petroleum resin, styrene-vinyl acetate copolymer resin, ethylene-vinyl acetate copolymer resin, and a wax resin; and a mixture thereof.

In some cases, uniformly and stably dispersing a magnetic toner in an aqueous medium may not be easily achieved when a polymer compound particles having a usual composition is used, because the polymer compound is hydrophobic and the surface of the magnetic toner has different properties from those of the usual polymer compound particles.

From these viewpoints, in an exemplary embodiment of the invention, a polymer compound in which monomer species that forms a polymer and the composition thereof are controlled as described below is used, whereby excellent dispersibility of a magnetic toner in an aqueous medium may be achieved and more excellent development properties may be exhibited. Hereinafter, the composition of a polymer compound which may be used in the exemplary embodiment of the invention will be described.

An example of the polymer compound includes a copolymer of ethylenically unsaturated monomers, the ethylenically unsaturated monomers including both a monomer having a hydroxyl group (i.e. a hydroxyl group-containing monomer) and a hydrophobic monomer. The amount of the hydroxyl group in the polymer compound may be from 0.1 mmol/g to 5.0 mmol/g or from about 0.1 mmol/g to about 5.0 mmol/g.

Here, in order to obtain a magnetic toner particle which has a good dispersibility in an aqueous medium while having a certain level of magnetic force, it is effective that a hydroxyl group is present on the surface of the particle. To that end, it is preferable that a component of the polymer compound (copolymer) that forms the particle has a hydroxyl group.

In a copolymer of ethylenically unsaturated monomers which may be used as the polymer compound, the amount of a hydroxyl group in the polymer compound may be adjusted to the optimum range in accordance with the copolymerization ratio of a hydroxyl group-containing monomer (or a hydrophilic monomer) and a hydrophobic monomer, the viewpoints of the dispersibility and stability of a magnetic toner in an aqueous medium, and the relationship with the amount of the magnetic powder included in a certain amount in the magnetic toner.

The amount of the hydroxyl group may vary depending on the amount of the magnetic powder. Therefore, the amount of the hydroxyl group may be defined as the amount of hydroxyl group that is contained in the polymer components other than the magnetic powder. The amount of the hydroxyl group is preferably from 0.1 mmol/g to 5.0 mmol/g or from about 0.1 mmol/g to about 5.0 mmol/g, more preferably from 0.2 mmol/g to 4.0 mmol/g, and still more preferably from 0.3 mmol/g to 3.0 mmol/g.

When the amount of a hydroxyl group is lower than 0.1 mmol/g or about 0.1 mmol/g, the dispersibility of a magnetic toner in an aqueous medium may be deteriorated in some cases. When the amount of a hydroxyl group exceeds 5.0 mmol/g or about 5.0 mmol/g, swelling properties of a magnetic toner in water may be large, sometimes resulting in deteriorated operability.

The amount of a hydroxyl group may be determined by a general titration method. For example, the amount of a hydroxyl group may be determined by adding a certain amount of a reagent, such as a pyridine solution of acetic anhydride, to the polymer, heating the mixture, adding water for hydrolysis, separating the resultant into particles and a supernatant with a centrifugal separator, and titrating the amount of a hydroxyl group in the supernatant with an ethanol solution of potassium hydroxide or the like using an indicator such as phenolphthalein.

The ethylenically unsaturated monomer refers to a monomer having an ethylenically unsaturated group such as a vinyl group. The following hydrophilic monomers and hydrophobic monomers may be included within the scope of the ethylenically unsaturated monomer according to an exemplary embodiment of the invention.

Examples of a hydroxyl-containing hydrophilic monomer include 2-hydroxyethyl(meth)acrylate, 2-hydroxypropyl (meth)acrylate, 3-hydroxypropyl(meth)acrylate, glycerol di(meth)acrylate, 1,6-bis(3-acryloxy-2-hydroxypropyl)-hexyl ether, pentaerythritol tri(meth)acrylate, isocyanuric acid tris-(2-hydroxyethyl) ester(meth)acrylate, and polyethylene glycol(meth)acrylate.

Note that, the term "(meth)acrylate" as used herein refers to either "acrylate" or "methacrylate" or both.

Among these, at least one selected from 2-hydroxyethyl (meth)acrylate and polyethylene glycol(meth)acrylate may be preferably used from the viewpoints of control of a copolymerization ratio with a hydrophobic monomer mentioned later, controllability of polymerization reaction, and the like.

Moreover, the polymer may have a carboxyl group in addition to the hydroxyl group. In this case, a monomer having a carboxyl group may be additionally used as another ethylenically unsaturated monomer.

Examples of the monomer having a carboxyl group include acrylic acid, methacrylic acid, methacryloyloxy ethyl monophthalate, methacryloyloxy ethyl monohexahydrophthalate, methacryloyloxy ethyl monomaleate, and methacryloyloxy ethyl monosuccinate.

Among these, methacryloyloxy ethyl monophthalate may preferably be used from the viewpoints of control of a copolymerization ratio with a hydrophobic monomer mentioned later, dispersion of the magnetic powder in a magnetic toner, controllability of polymerization reaction, and the like.

Examples of a hydrophobic ethylenically unsaturated monomer include: an aromatic vinyl monomer such as styrene or α-methyl styrene; an alkyl(meth)acrylate having an alkyl or aralkyl group having 1 to 18 (more preferably 2 to 16)

carbon atoms, such as methyl(meth)acrylate, ethyl(meth) acrylate, propyl(meth)acrylate, butyl(meth)acrylate, cyclohexyl(meth)acrylate, 2-ethylhexyl(meth)acrylate, lauryl (meth)acrylate, or benzyl(meth)acrylate; an alkoxyalkyl (meth)acrylate having an alkylene group having 1 to 12 (preferably 2 to 10) carbon atoms, such as methoxymethyl (meth)acrylate, methoxyethyl(meth)acrylate, ethoxymethyl (meth)acrylate, ethoxyethyl(meth)acrylate, ethoxybutyl (meth)acrylate, n-butoxymethyl(meth)acrylate, or n-butoxyethyl(meth)acrylate; an amino group-containing (meth)acrylate such as diethylaminoethyl(meth)acrylate or dipropylaminoethyl(meth)acrylate; acrylonitrile; ethylene; vinyl chloride; and vinyl acetate.

Among these, styrene, methyl(meth)acrylate, butyl(meth) acrylate, 2-ethylhexyl(meth)acrylate, lauryl(meth)acrylate, ethoxybutyl(meth)acrylate, benzyl(meth)acrylate, and diethylaminoethyl(meth)acrylate are preferable, and styrene, methyl(meth)acrylate, and butyl(meth)acrylate are particularly preferable.

The amount of the hydrophobic monomer copolymerizable with the hydrophilic monomer is preferably from 1% to 99% by weight, and more preferably from 5% to 95% by weight, with respect to the total monomer components. In particular, when a monomer having a carboxyl group, such as methacryloyloxy ethyl monophthalate, is used as the ethylenically unsaturated monomer, in combination with a monomer having a hydroxyl group, the amount of the hydrophobic monomer is preferably from 20% to 99% by weight, and more preferably from 50% to 90% by weight, with respect to the total monomer components.

When the amount is lower than 1% by weight, the amount of the hydroxyl group in the polymer excessively increases, sometimes resulting in failure of uniform polymerization at the time of producing the polymer. When the amount exceeds 99% by weight, a hydrophilicity effect due to the hydroxyl group may not be achieved for a polymer.

As another monomer, a crosslinking agent may be mixed as required with a reactive mixture (including the ethylenically unsaturated monomers or the like) which is dispersed in an aqueous medium as described later. By adding a crosslinking agent to a monomer mixture solution, aggregation under polymerization may be suppressed and dispersion stability may be secured.

As the crosslinking agent to be used, a known crosslinking agent may be selected and used. Examples of the crosslinking agent include divinyl benzene, ethylene glycol di(meth)acrylate, diethylene glycol di(meth)acrylate, methylene bis(meth) acryl amide, glycidyl(meth)acrylate, and 2-([1'-methylpropylidene amino]carboxyamino)ethyl methacrylate. Among these, divinyl benzene, ethylene glycol di(meth)acrylate, and diethylene glycol di(meth)acrylate are preferable, and divinyl benzene is particularly preferable.

Furthermore, a polymer compound may be mixed with a non-crosslinking resin from the viewpoint of improving fixability. The non-crosslinking resin may not be particularly limited as far as it is a polymer which enables fixing particles on a recording medium such as paper or a film in response to: application of an external energy such as heat, ultraviolet light, or an electron beam; solvent vapor; solvent volatilization from the polymer; or the like.

Specific examples of a non-crosslinking resin include homopolymers or copolymers of: styrenes such as styrene or chlorostyrene; monoolefins such as ethylene, propylene, butylene, or isoprene; vinyl esters such as vinyl acetate, vinyl propionate, vinyl benzoate, or vinyl acetate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate; vinyl ethers such as vinyl methyl ether, vinyl ethyl ether, or vinyl butyl ether; and vinyl ketones such as vinyl methyl ketone, vinyl hexyl ketone, or vinyl isopropenyl ketone.

Other Components

A magnetic toner may further include a dye, an organic pigment, carbon black, titanium oxide, or the like, which may be mixed for coloring. In this case, the additive may be directly mixed with a mixture of the monomers in which the magnetic powder is dispersed therein. For example, particularly when a pigment such as an organic pigment, carbon black, or titanium oxide is mixed, the pigment may be preliminary mixed with and dispersed in the non-crosslinked resin by a known method using a roll mill, a kneader, an extruder, or the like, and then the resultant mixture may be mixed in the mixture of the polymerizable monomers or the like.

Method of Preparing Magnetic Toner

Regarding a method of preparing the magnetic toner that includes the monomers and the like, for example, the ethylenically unsaturated monomers, a polymerization initiator, and the other components are mixed to obtain a mixed solution including the monomers and the like. The mixing method is not particularly limited.

Any conventional method may be used for dispersing the magnetic powder in the mixed solution. Namely, for example, a dispersing machine such as a ball mill, a sand mill, an attritor, or a roll mill may be used. When the monomer components are preliminary separately polymerized and the magnetic powders are dispersed in the resultant polymer, a kneader such as a roll mill, a kneader, a banbury mixer, or an extruder may be used.

In order to obtain a magnetic toner according to an exemplary embodiment of the invention, any known method may be used. For example, suspension polymerization, emulsion polymerization, dispersion polymerization, seed polymerization, or the like may be used. Furthermore, suspension polymerization may be performed using an emulsification method known as membrane emulsification.

The magnetic toner thus obtained has a number average particle diameter of preferably from 0.1 μm to 20 μm or from about 0.1 μm to about 20 μm, and more preferably from 1.0 μm to 8.0 μm. When the number average particle diameter is less than 0.1 μm, the particle diameter is excessively small, sometimes resulting in difficulty of handling. When the number average particle diameter exceeds 20 μm, high image quality may not be achieved when the magnetic toner is used as an image forming material.

When a polymer compound has a carboxyl group, the amount of the carboxyl group may be from 0.005 mmol/g to 0.5 mmol/g. When the amount of the carboxyl group is within the range, good dispersibility and good swelling inhibitory effect in an aqueous medium may be achieved even when the number of the carboxyl group is smaller than that of the hydroxyl group, and these properties may be prevented from fluctuation due to other functional groups.

The amount of the carboxyl group is more preferably from 0.008 mmol/g to 0.3 mmol/g, and still more preferably from 0.01 mmol/g to 0.1 mmol/g.

The amount of the carboxyl group may be determined by a general titration method. For example, the amount of the carboxyl group can be determined by adding a reagent, such as an ethanol solution of potassium hydroxide, to the polymer compound for neutralization reaction, separating the resultant into particles and a supernatant with a centrifugal separator, and titrating the amount of the carboxyl group in the supernatant including an excessive amount of potassium hydroxide with an isopropanol hydrochloric acid solution or the like using an automatic titrator.

Aqueous Medium

The term "aqueous medium" as used herein refers to a solvent including water in an amount of 50% by weight or more with respect to the total weight of the solvent. The term "water" as used herein refers to purified water such as distilled water, ion exchange water, and ultrapure water. As an aqueous medium, water or a solution obtained by adding a water-soluble organic solvent, such as methanol or ethanol, to water may be used. Among these, water is particularly preferable. When a water-soluble organic solvent is added, the amount thereof may vary depending on properties of a monomer to be suspended, but may be 30% by weight or less, and preferably 10% by weight or less, with respect to the total solvent.

Liquid Developer

In the production of a liquid developer, various auxiliary additives, which may be used in a conventional aqueous dispersion of particles, may be used in combination. Examples of the auxiliary additives include a dispersant, an emulsifier, a surfactant, a stabilizer, a moistening agent, a thickener, a foaming agent, a defoaming agent, a coagulant, a gelling agent, a sedimentation inhibitor, a charge controlling agent, an antistatic agent, an aging inhibitor, a softener, a plasticizer, a filler, a colorant, a fragrant substance, an adhesion inhibitor, and a releasing agent.

Examples of the surfactant include: known surfactants such as an anionic surfactant, a nonionic surfactant, and a cationic surfactant; a silicone surfactant such as a polysiloxane oxyethylene adduct; a fluorine-containing surfactant such as a perfluoroalkyl carboxylic acid salt, a perfluoroalkyl sulfonic acid salt, or an oxyethylene perfluoroalkyl ether; and a biosurfactant such as spiculisporic acid, rhamnolipid or lisolecitin.

As a dispersant, any polymer having a hydrophilic structural moiety and a hydrophobic structural moiety may be used. Examples thereof include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, a alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. These copolymers each may be a random copolymer, a block copolymer, or a graft copolymer.

Moreover, in order to control vaporization or interfacial properties, a water-soluble organic solvent may be used in combination with an aqueous medium. The water-soluble organic solvent may be an organic solvent which is not separated into two phases when it is put into water. Examples thereof include a monohydric alcohol, a polyhydric alcohol, a nitrogen-containing solvent, a sulfur-containing solvent, and their derivatives.

Further, for the purpose of, for example, controlling electroconductivity and pH of ink, an alkaline metal compound such as potassium hydroxide, sodium hydroxide, or lithium hydroxide; a nitrogen-containing compound such as ammonium hydroxide, triethanolamine, diethanolamine, ethanolamine, or 2-amino-2-methyl-1-propanol; an alkaline earth metal compound such as calcium hydroxide; an acid such as sulfuric acid, hydrochloric acid, or nitric acid; a salt of a strong acid and a weak alkaline, such as ammonium sulfate, may be added to the aqueous medium.

In addition, if necessary, for antifungal, antiseptic, or anticorrosion purpose or the like, benzoic acid, dichlorophen, hexachlorophene, sorbic acid, or the like may further be added to the aqueous medium. Moreover, an antioxidant, a viscosity modifier, a conductivity agent, a UV absorber, a chelating agent, or the like may further be added to the aqueous medium.

The average particle diameter of the magnetic toner dispersed in a liquid developer is preferably from 0.1 μm to 20 μm, and more preferably from 1 μm to 8 μm. The average particle diameter of the dispersed magnetic toner is a volume average particle diameter which may be determined with a COULTER COUNTER MULTISIZER 3 (trade name, manufactured by BECKMAN COULTER Corp.).

When a hydroxyl group is present on the particle surfaces, the magnetic toner exhibits good dispersibility in an aqueous medium.

Therefore, when the liquid developer is used, micro variation in surface tension in the liquid may not occur, and variation among particles in mobility of particles relative to the magnetic force at the time of development may be small. Accordingly, adhesion of the liquid to a magnetic drum after development based on water repellency on the surface of the magnetic drum and the generation of image fogging are more efficiently reduced.

The production of the liquid developer may be performed in accordance with the following procedure, but is not limited thereto.

First, a dispersion medium which includes water as a main solvent and the respective additives described above is prepared using a magnetic stirrer. Then, the magnetic polymer particles are dispersed in the dispersion medium by a known method and/or using a known apparatus. Specifically, a dispersing apparatus such as a ball mill, a sand mill, an attritor, or a roll mill may be used. Moreover, the particles may be dispersed by a method of dispersing particles by rotating special agitation blades at high speed, such as by a mixer; a method of dispersing particles by the shearing force of a rotor and stator, which is known as a homogenizer; a method of dispersing particles using ultrasonic waves; or the like.

An aliquot of the dispersion liquid is sampled and observed by microscope or the like to confirm that the magnetic polymer particles are independently dispersed from one another in the dispersion liquid. Then, an additive such as an antiseptic agent may be added and dissolution thereof is confirmed. After that, the thus-obtained dispersion liquid is filtered with, for example, a membrane filter having a pore diameter of 100 μm to remove impurity solids and crude particles, thereby obtaining a liquid developer which serves as an image forming recording liquid.

The viscosity of the liquid developer may vary depending on an image forming system to be used, but may be from 1 mPa·s to 500 mPa·s. When the viscosity of a liquid developer is lower than 1 mPa·s, the amount of the magnetic toner and/or the amount of the additive may not be sufficient, sometimes resulting in failure in attaining a sufficient image density. When the viscosity of a liquid developer is higher than 500 mPa·s, handling may become difficult or development properties may be deteriorated in some cases owing to the excessively high viscosity.

Image Forming Apparatus

Hereinafter, an image forming device according to an exemplary embodiment of the invention will be described. It should be noted that a process cartridge will be also described referring to the following exemplary embodiments of the image forming device.

An image forming device of an exemplary embodiment of the invention includes a magnetic latent image holder (hereinafter sometimes referred to as an "image holder"), a magnetic latent image forming device that forms a magnetic latent image on the magnetic latent image holder, a developer storing unit that stores a liquid developer including a magnetic toner and an aqueous medium, a developer supply device that supplies the liquid developer to the magnetic latent image holder on which the magnetic latent image has been formed so as to develop the magnetic latent image as a toner image, a transfer member that transfers the toner image to a recording medium, and a demagnetization device that demagnetizes or erases the magnetic latent image formed on the magnetic latent image holder. As the liquid developer, the liquid developer according to the exemplary embodiment of the invention described above may be applied.

Here, in so-called liquid magnetography using a liquid developer, since the toner image on the image holder immediately after development usually contains a large amount of excess developer, the excess developer needs to be removed in some cases, by providing a drying process prior to transferring the toner image to the recording medium such as a sheet of paper.

Therefore, an image holding member whose surface has water repellency may be used. An aqueous medium which is used as a dispersion medium in the liquid developer has a high surface tension due to hydrogen bonding of water. Therefore, when the aqueous medium is used in combination with an image holder whose surface has water repellency, the liquid that serves as a dispersion medium is hardly transferred to the image holder even when the liquid developer contacts the image holder at the time of development, and the toner image may be transferred to a recording medium without leaving liquid on the image holder.

Furthermore, at the time of development, an aqueous medium having a high surface tension may be prevented from wet-spreading over the surface of the image holding member. On the other hand, a magnetic toner which has high mobility and may be uniformly dispersed in the developer transfers only to a magnetic latent image owing to magnetic force simultaneously with contacting the image holding member, and thus a development environment may be provided in which image fogging hardly occurs.

Accordingly, a high quality image in which generation of image fogging may be reduced may be stably formed by reducing the influence of residual liquid on the magnetic latent image holder after development, while also further adapting the image forming apparatus to be usable in an office environment or the like.

An image formation process applied to the exemplary embodiment does not refer to a process utilizing an electrostatic latent image, such as a so-called electrophotography process, a process of forming an electrostatic latent image with ions or the like on a dielectric material (ionography), or a process of forming an electrostatic latent image on a charged dielectric material by heat of a thermal head according to image information, and refers to a process of forming a magnetic latent image on an image holder to form a toner image.

Hereinafter, an image forming apparatus involving a magnetic development process using a liquid developer in an exemplary embodiment of the invention will be described with reference to drawings.

FIG. 1 is a schematic configuration diagram illustrating an example of an image forming apparatus according to an exemplary embodiment of the invention. The image forming apparatus 100 includes a magnetic drum (a magnetic latent image holder) 10, a magnetic head (a magnetic latent image forming device) 12, a development device (including a developer storing unit and a developer supply device) 14, an intermediate transfer member (a transfer unit) 16, a cleaner 18, a demagnetization device 20, and a transfer-fixing roller (a transfer unit) 28. The magnetic drum 10 has a cylindrical shape, and, on the outer circumference of the magnetic drum 10, the magnetic head 12, the development device 14, the intermediate transfer member 16, the cleaner 18, and the demagnetization device 20 are consecutively provided.

Hereinafter, the operation of the image forming apparatus 100 will be briefly described.

First, the magnetic head 12 is connected to, for example, an information device (not shown) and receives binarized image data sent from the information device. The magnetic head 12 emits magnetic force while it scans the side surface of the magnetic drum 10, whereby a magnetic latent image 22 is formed on the magnetic drum 10. Note that, in FIG. 1, the magnetic latent image 22 is shown by a hatched part in the magnetic drum 10.

The development device 14 includes a developing roller (a developer supply device) 14*a* and a developer storage container (a developer storing unit) 14*b*. The developing roller 14*a* may be provided in such a manner as to be partially immersed in a liquid developer 24 stored in the developer storage container 14*b*.

In the liquid developer 24, toner particles are uniformly dispersed. The positional variation in concentration of the toner particles in the liquid developer 24 may further be reduced by, for example, further providing a stirrer in the developer storage container 14*b* so as to keep stirring the liquid developer 24 at a given rotational speed. Thus, the liquid developer 24 in which the variation in concentration of toner particles has been reduced may be supplied to the developing roller 14*a* which rotates in the direction of arrow A of figures.

The liquid developer 24 supplied to the developing roller 14*a* is then conveyed to the magnetic drum 10 while the amount of the liquid developer on the developing roller 14*a* is limited to a certain amount by a regulation device which will be described later. Then, the liquid developer is 24 supplied onto the magnetic latent image 22 in a position where the developing roller 14*a* and the magnetic drum 10 come close to each other (or contact with each other). Thus, the magnetic latent image 22 may be developed to form a toner image 26.

The toner image 26 developed as described above is then conveyed by the magnetic drum 10 which rotates in the direction of arrow B of figures, and is transferred to a sheet of paper (a recording medium) 30. In an exemplary embodiment of the invention, in order to increase transfer efficiency of the toner image to the recording medium, including separation efficiency from the magnetic drum 10, and in order to perform fixation simultaneously with transferring to the recording medium, the toner image may be temporarily transferred to the intermediate transfer member 16 before the transfer to the sheet of paper 30.

Since toner particles have almost no electrical charge, shearing transfer (non-electric field transfer) may be performed for transferring the toner image to the intermediate transfer member 16. Specifically, the magnetic drum 10 which rotates in the direction of arrow B and the intermediate transfer member 16 which rotates in the direction of arrow C may be brought into contact with each other via a certain nip (i.e. contact surface having a certain length in a rotation direction). Then, the toner image 26 is transferred to the intermediate transfer member by adsorption force, which is higher than the magnetic force between the magnetic drum 10 and the toner image 26. At this time, circumferential velocities of the magnetic drum 10 and the intermediate transfer member 16 may be different from each other.

Subsequently, the toner image which has been conveyed in the direction of arrow C by the intermediate transfer member 16, is transferred to and fixed on the sheet 30 at the contact area with the transfer-fixing roller 28.

The transfer-fixing roller 28 sandwiches the sheet 30 with the intermediate transfer member 16, so that the toner image on the intermediate transfer member 16 is adhered onto the sheet 30, whereby the toner image may be transferred to the sheet 30, and, simultaneously therewith, the toner image may be fixed on the sheet. Depending on the properties of the toner, the fixation of the toner image may be performed only by application of pressure, or may be performed by applying pressure and heat by using a transfer-fixing roller 28 equipped with a heating element.

Meanwhile, after the toner image 26 has been transferred to the intermediate transfer member 16, the toner that remains on the magnetic drum 10 is conveyed to the contact area with the cleaner 18, and is collected by the cleaner 18. After the cleaning, the magnetic drum 10 keeps rotating to a demagnetization area while holding a magnetic latent image 22.

The demagnetization device 20 erases the magnetic latent image 22 that has been formed on the magnetic drum 10. The magnetic condition of the magnetic layer of the magnetic drum 10 may be restored, by the cleaner 18 and demagnetization device 20, to a condition before the image was formed. By repeating the foregoing operations, images sent from the information device may be visualized successively in a short time. It should be noted that the magnetic head 12, the development device 14, the intermediate transfer member 16, the transfer-fixing roller 28, the cleaner 18, and the demagnetization device 20, which are provided in the image forming device 100, may operate in synchronism with the rotational speed of the magnetic drum 10.

Next, each constituents of the image forming apparatus of the exemplary embodiment will be successively described.

Magnetic Latent Image Holder

The magnetic drum (magnetic latent image holder) 10 may include: a drum made of a metal such as aluminum; an underlying layer which is made of Ni, Ni—P, or the like and formed in a thickness of from about 1 μm to about 30 μm on the drum; a magnetic recording layer which is made of Co—Ni, Co—P, Co—Ni—P, Co—Zn—P, Co—Ni—Zn—P, of the like and formed in a thickness of from about 0.1 μm to about 10 μm on the underlying layer; and a protective layer which is made of Ni, Ni—P, or the like and formed in a thickness of from about 0.1 μm to about 5 μm. Each layer may be formed by plating. Specifically, when plating of the underlying layer has a defect such as pinholes, a defect may be generated on the magnetic recording layer. Thus, it is preferable that the underlying layer may be formed by dense and even plating. Besides plating, each layer may be formed by sputtering, vacuum deposition, or the like. Furthermore, the underlying layer and the protective layer may be non-magnetic. It is preferable that the surface accuracy of each layer may be maintained at a certain degree by tape polishing or the like from the viewpoint of maintaining, with high accuracy, a gap between the magnetic latent image holder and the magnetic recording head 12 that forms a magnetic latent image.

The thickness of the magnetic recording layer may be from 0.1 μm to 10 μm. The magnetic properties of the magnetic recording layer may be as follows: coercive force is from 16,000 A/m to 80,000 A/m (or from 200 oersted to 1,000 oersted (Oe)) and residual magnetic flux density is from 100 mT to 200 mT (or from 1,000 gauss to 2,000 gauss (G)).

An exemplary configuration of the magnetic drum 10 of longitudinal magnetic recording is described above. In the case of vertical magnetic recording, a magnetic drum may have, but not limited to, a configuration in which a recording layer made of Co—Ni—P or the like is formed on a non-magnetic layer or a configuration in which a soft magnetic layer having a high magnetic permeability may be formed under the recording layer. The magnetic latent image holder not limited to a drum as used in the first exemplary embodiment, and may be a belt or the like.

In an exemplary embodiment of the invention, the magnetic drum 10 having water repellency may be used. The term "water repellency" as used herein refers to a property of repelling water, and specifically refers to a contact angle between the surface of the magnetic drum 10 and pure water of 70° or more.

In exemplary embodiments of the invention, the contact angle between the magnetic drum 10 and pure water is preferably 70° or more, and more preferably 100° or more. When the contact angle is less than 70°, a liquid may remain on the magnetic drum or image fogging may occur after development in some cases even when a liquid developer including an aqueous medium described later is used in the development.

The contact angle on the surface of the magnetic drum 10 may be determined as follows. Under the environment of a temperature of 25° C. and a relative humidity of 50% RH, 3.1 μl of pure water is dripped on the surface of a magnetic drum, and, after 15 seconds, the contact angle is measured with using a contact angle meter (CA-X (trade name, manufactured by Kyowa Interface Science Co., Ltd.)). The measurement is performed at four different points at the ends and center of the magnetic drum, respectively, along the circumferential direction of the drum axis. The average of the four measurement values is regarded as a contact angle.

In order to allow the surface of the magnetic drum 10 to have a preferable contact angle, a surface coating may be applied on the surface of the magnetic drum that is configured as described above.

Examples of the surface coating include a fluorine-containing lubricating plating and a coating including a fluorine atom-containing or silicon atom-containing polymer. The fluorine-containing lubricating plating is a functional plating that is prepared by co-depositing and compositing a fluororesin (e.g., polytetrafluoroethylene: PTFE) with an electroless nickel plating. In the resultant coating, the PTFE particles are evenly deposited, whereby the coating has both properties of electroless nickel plating and PTEF resin.

Regarding the coating including a fluorine atom-containing or silicon atom-containing polymer, for example, a polymer having a fluorine-containing ring structure, a copolymer of a fluoroolefin and a vinyl ether, a photo-polymerizable fluororesin composition, or the like may be applied on the surface of the protection layer, or a fluorine atom-containing polymer may be applied on the entire surface of the protection layer by sputtering.

Among these, the fluorine-containing lubricating plating is preferable from the viewpoints of adhesiveness with a lower plating layer, durability, or the like. The fluorine-containing lubricating plating or the fluororesin coating may be applied on the protective layer, or a layer that is formed from the fluorine-containing lubricating plating or the like may be used as the protective layer.

The thickness of the surface layer formed by surface coating is preferably from 0.1 μm to 5 μm, and more preferably from 0.3 μm to 3 μm.

Magnetic Latent Image Forming Device

A magnetic latent image forming device (magnetic latent image forming unit) includes a magnetic head 12 and a driving circuit thereof. The magnetic head 12 may roughly be classified into a full-line magnetic head and a multi-channel magnetic head. In the case where the magnetic head 12 is a full-line magnetic head, it is not necessary to move the magnetic head 12 for scanning. In contrast, in the case where the magnetic head 12 is a multi-channel magnetic head, it is necessary to move the magnetic head 12 across the magnetic drum 10 for scanning. Examples of a method for scanning include a serial scanning and a helical scanning. In the helical scanning, the rotation speed of the magnetic drum 12 is changed especially only in the latent image forming step, whereby recording speed may be increased in the latent image forming step.

On the other hand, in the case of the full-line magnetic head, for example, a head having about 500 channels is necessary to cover a range of an A4 size paper (ISO 216) in the width direction thereof when resolution is set to be 600 dpi (dpi: number of dots per 1 inch). When plural heads are arrayed into a full-line configuration, it is not necessary to move the resultant head for scanning, thereby enabling an extremely high speed recording. For making the full-line configuration, head cores of the heads are required to be superimposed to each other. As the resolution becomes higher, the track pitch becomes narrower. Therefore, coils which are inserted into the head cores are required to be as thin as possible, and for example, planer sheet coils may be used.

By applying an electric current to the coil of each channel of the magnetic head 12, magnetic flux leakage arises at the end of a magnetic pole. This magnetizes a magnetic recording medium, thereby forming a magnetic latent image. The output from the magnetic head 12 may be two to three times of the coercive force of the magnetic recording layer in the magnetic drum 10. The magnetic latent image thus formed may not be erased unless erased by the demagnetization device 20, thereby providing a multi-copy function by repeating the steps of development, transfer, fixation, and cleaning. Moreover, the magnetic latent image is less likely to be influenced by humidity, and thus is excellent in environmental stability as compared with that formed by an electrostatic device.

Developer Storing Unit and Developer Supply Device

Figure 2:
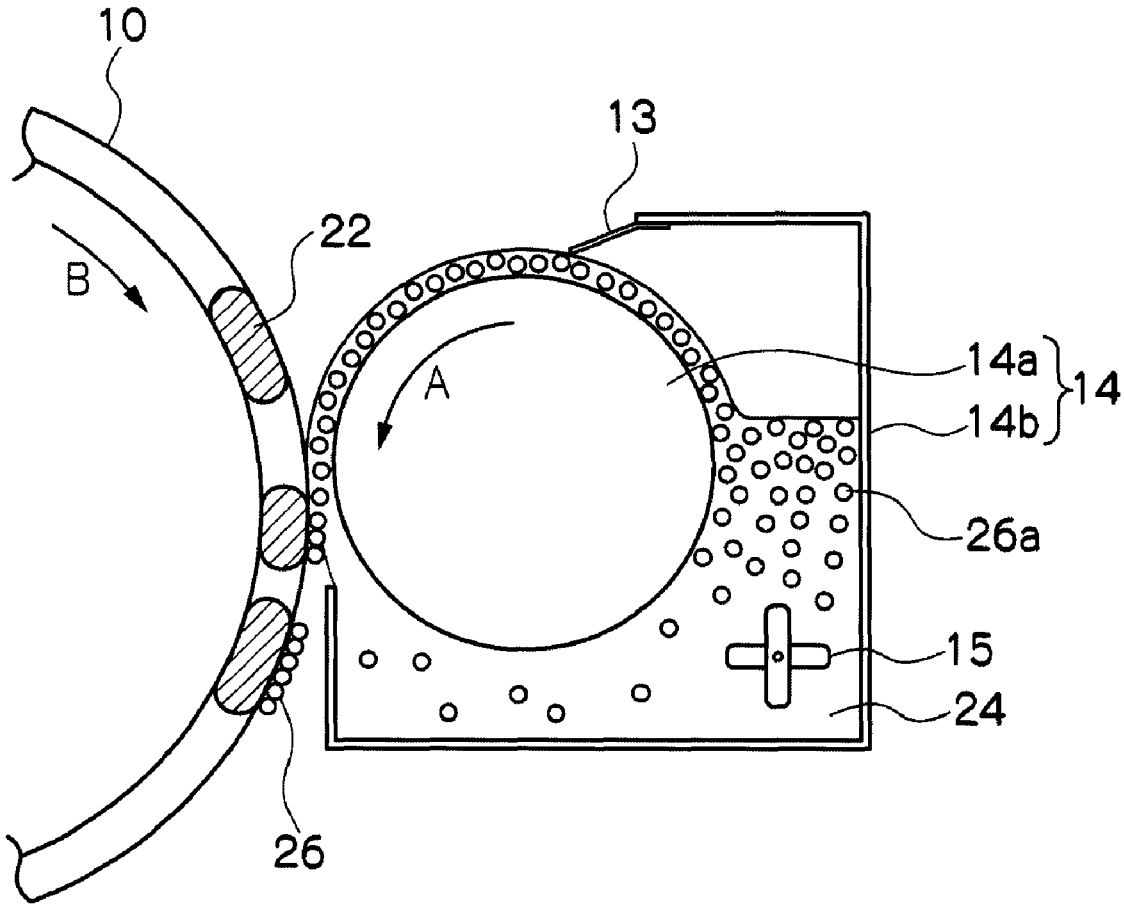
FIG. 2 is an enlarged schematic diagram illustrating a development area in an example of an image forming apparatus according to an exemplary embodiment of the present invention.

FIG. 2 is an enlarged schematic view illustrating the development area shown in FIG. 1.

The development device (developer supply device) 14 includes the developer storage container 14*b* and the developing roller 14*a* which supplies the liquid developer 24 stored in the developer storage container 14*b* to a toner supply area (hereinafter sometimes referred to as a "supply area") of the magnetic drum 10. As illustrated in FIG. 2, the developing roller 14*a* holds a layer of the liquid developer 24 on the peripheral surface thereof, and is provided apart from the magnetic drum 10. For example, a process cartridge may be composed of the magnetic drum and the development device. A regulation device 13 that maintains the thickness of the film formed of the liquid developer 24 at a certain thickness may be provided at an upstream position of the supply area. The regulation device 13 may be a plate-shaped member extending across the entire width of the developing roller 14*a* in the axis direction thereof, and may be located in such a manner that a surface thereof is apart from the peripheral surface of the developing roller 14*a* by a certain distance corresponding to a desired toner film thickness.

In the development device 14, the liquid developer 24 including toner particles 26*a* and an aqueous medium is stored in the developer storage container 14*b*. The liquid developer 24 is continuously stirred at a certain rotational speed with a stirrer 15 provided inside the developer storage container 14*b*, thereby reducing positional variation in concentration of the toner particles 26*a* in the liquid developer 24. Thus, the liquid developer 24 in which variation in concentration of the toner particles has been reduced may be supplied to the developing roller 14*a*.

Although not illustrated in FIG. 2, a supply roller which rotates in contact with or in close vicinity to the developing roller 14*a* may be provided for supplying the liquid developer to the developing roller 14*a*.

The developing roller 14*a* includes, for example, a plurality of magnetic poles including an S-magnetic pole and an N-magnetic pole inside thereof in the circumferential direction. The S-magnetic pole and the N-magnetic pole are fixed so as not to rotate with the developing roller 14*a*. One of the magnetic poles may be provided between the regulation device 13 and the supply area. Accordingly, the liquid developer 24 including the magnetic toner, which is held on the developing roller 14*a*, may be held by the magnetic line (i.e. development magnetic field) of these magnetic poles, and may be conveyed to the magnetic drum 10.

It should be noted that the developing roller 14*a* does not need to be a magnetic roller insofar as the roller surface itself has an ability to convey the liquid developer. For example, an anilox roller, a sponge roller, or the like may be used.

The regulation device 13 is provided at a position between a position where the liquid developer 24 in the developer storage container 14*b* is picked up by the developing roller 14*a* and a position where the liquid developer 24 is supplied to the magnetic drum 10. The amount of the liquid developer 24 supplied to the magnetic latent image 22 is determined by the gap between the regulation device 13 and the developing roller 14*a*. Examples of a material of the regulation device include rubber and phosphor bronze. The liquid developer 24 whose amount is limited to a certain amount by the regulation device 13 is conveyed to the magnetic drum 10, and is supplied to the magnetic latent image 22, whereby the magnetic latent image 22 is developed to form a toner image 26.

At the time of the development, since the toner particle is a magnetic toner, development may be performed without applying a magnetic field to the developing roller 14*a*. However, in order to perform more efficient development, a magnetic field may be applied to the developing roller 14*a*.

Transfer Unit and Fixation Unit

The toner image visualized by the developer device 14 is transferred to the sheet 30 by a transfer unit (or transfer member). As described above, in an exemplary embodiment of the invention, the toner image is not directly transferred to the sheet 30 from the magnetic drum 10, but the toner image is first temporarily transferred to the intermediate transfer member 16, and then transferred onto and fixed on the sheet 30. First, the transfer to the intermediate transfer member 16 will be described.

The intermediate transfer member 16 contacts the magnetic drum 10, and the toner image 26 is transferred. Examples of the transfer system generally include an electrostatic transfer system, a pressure transfer system, and an electrostatic pressure transfer system in which the electrostatic transfer system and the pressure transfer system are used in combination. However, as described above, since the toner particles do not have a charge in the exemplary embodiment, neither the electrostatic transfer system nor the electrostatic pressure transfer system is used. In contrast, according to a usual pressure transfer system, the toner image is adhered and transferred to the surface of the transfer medium while being plastically deformed by the pressure between the magnetic drum 10 and the transfer medium. The pressure transfer system may be used in combination with shearing transfer.

In first exemplary embodiment, since the toner image 26 is shifted to the intermediate transfer member 16 due to adsorption force, which is stronger than the magnetic force that the magnetic drum 10 exerts on the toner image 26 on the magnetic drum 10 as described above, adhesiveness may be provided to the intermediate transfer member 16 so as to conduct adhesive transfer. For this purpose, for example, a silicone rubber layer having a low hardness may be formed on the surface of the intermediate transfer member 16.

Subsequently, the toner image 26 which has been transferred to the intermediate transfer member 16 is transferred to the sheet 30.

In FIG. 1, the transfer-fixing roller 28 is disposed on the opposite side of the intermediate transfer member 16 to the magnetic drum 10, with the intermediate transfer member 16 located therebetween, in such a manner that the transfer-fixing roller 28 is positioned so as to form a nip with the intermediate transfer member 16. A sheet 30 is fed to the nip (or a contact area) between the intermediate transfer member 16 and the transfer-fixing roller 28 in accordance with the timing of the toner image 26 on the intermediate transfer member 16. The transfer-fixing roller 28 may include a stainless-steel substrate, a silicon rubber layer, and a fluoro-rubber layer, for example. The sheet 30 which passes through the nip is pressed onto the intermediate transfer member 16, whereby the toner image on the intermediate transfer member 16 may be transferred to the sheet 30.

In the exemplary embodiment, the toner image 26 is transferred from the intermediate transfer member 16 to the sheet 30, and at the same time the toner image 26 is fixed on the sheet 30. Specifically, when the intermediate transfer member 16 is a roller as shown in FIG. 1, it composes a roller pair with the transfer-fixing roller 28. Therefore, the intermediate transfer member 16 and the transfer-fixing roller 28 may serve as a fixing roller and a press roller respectively in a fixation apparatus and provide fixing function. Namely, when the sheet 30 passes through the nip, the toner image is transferred and at the same time is pressed by the transfer-fixing roller 28 onto the intermediate transfer member 16, whereby the toner particles that form the toner image may be softened and infiltrate into the fibers of the sheet 30.

Under this condition, the toner image may be fixed on the sheet 30 depending on the toner to be used. However, when fixing is not sufficient, the toner image may be heated with the fixing transfer roller or the like so that the toner image is fused, whereby the toner may infiltrate into the fibers of the sheet 30 and the toner image may be fixed as a fixed image 29. After that, the fixed image 29 is hardly peeled off even when the sheet 30 is bent or folded, or an adhesive tape applied thereon and then removed therefrom.

It should be noted that the transfer and fixation to the sheet 30 are performed at the same time in the exemplary embodiment, but the transfer and fixation may be separately performed, and for example, the fixation may be performed after the transfer. In this case, a transfer roller to which a toner image is transferred from the magnetic drum 10 may have a function similar to that of the intermediate transfer member 16.

Cleaner

When the transfer efficiency of the toner image from the magnetic drum 10 to the intermediate transfer member 16 does not reach 100%, a part of the toner image 26 may remain on the magnetic drum 10 after the transfer. A cleaner 18 removes the remaining toner. The cleaner 18 includes a cleaning blade made of rubber or the like and a container in which the remaining magnetic toner is collected.

It should be noted that when the transfer efficiency is nearly 100% and the residual toner does not cause a problem, the cleaner 18 may not be provided.

Demagnetization Device

When a new image is formed again, the magnetic latent image is required to be erased by a demagnetization device before a new magnetic latent image is formed by the magnetic head 12. The demagnetization device 20 may be classified into two: a permanent magnet system and an electromagnet system. In a demagnetization device of the permanent magnet system, the magnetic drum 10 is magnetized in the circumferential direction thereof so as not to leak magnetic flux locally. The demagnetization device of the permanent magnet system requires no energy such as electric power and is cost-effective. However, when the magnetic latent image is not to be erased, the demagnetization device 20 is required to be moved from the magnetic drum 10 so as to increase the magnetic distance and to reduce the demagnetization field. In contrast, a demagnetization device of the electromagnet system includes a yoke and a coil, and an electric current flowing is required to flow. When a magnetic latent image is not to be erased, the demagnetization field may be made to be zero by switching off the current, whereby the control thereof is relatively easy.

In exemplary embodiments of the invention, either of the permanent magnet system and the electromagnet system may be used.

EXAMPLES

Hereinafter, the present invention will be described further specifically with reference to Examples. However, the invention is not limited to these Examples. Hereinafter, unless otherwise specified, "part(s)" and "%" mean "part(s) by weight" and "% by weight", respectively.

Example A

Comparative Example A1

Production of Magnetic Polymer Particles 400 parts of a styrene acrylic resin (S-LEC P-SE-0020, trade name, manufactured by Sekisui Chemical Co., Ltd.) are added to 600 parts of magnetic powder MTS-010 (trade name, manufactured by JFE Chemical Corporation: ultra fine iron particle having a saturation magnetization of 200.1 emg/g and a volume average particle diameter of 0.8 μm). The mixture is kneaded with a pressurizing kneader, thereby obtaining a magnetic powder whose surface is coated with a resin (magnetic powder content: 60%).

17 parts of hydroxyethyl methacrylate (manufactured by Wako Pure Chemical Industries Ltd.), 57 parts of a styrene monomer (manufactured by Wako Pure Chemical Industries Ltd.), and 1 part of divinyl benzene (manufactured by Wako Pure Chemical Industries Ltd.) are mixed. Thereafter, 40 parts of the surface-treated magnetic powder is added to the mixture, and the mixture is dispersed with a ball mill for 48 hours. To 90 parts of the thus-obtained magnetic powder dispersion, 5 parts of azobisisobutyronitrile (manufactured by Wako Pure Chemical Industries Ltd.) as a polymerization initiator are added, thereby producing a mixture containing a monomer and a magnetic powder.

An aqueous solution is prepared in which 28 parts of sodium chloride (manufactured by Wako Pure Chemical Industries, Ltd.) are dissolved in 160 parts of ion-exchanged water. To the aqueous solution, 30 parts of calcium carbonate (trade name: LUMINUS, manufactured by Maruo Calcium Co., Ltd.) and 3.5 parts of carboxymethylcellulose (trade name: CELLOGEN, manufactured by Dai-ichi Kogyo Seiyaku Co., Ltd.) are added as dispersion stabilizers, and are dispersed using a ball mill for 24 hours, thereby obtaining a dispersion medium.

To 200 parts of the dispersion medium, the mixture including the monomer and the magnetic powder is added and emulsified using an emulsifying apparatus (trade name: HIGH-FLEX HOMOGENIZER, manufactured by MST Corp.) at 8,000 rpm for 3 minutes to obtain a suspension liquid. At this time, the number average particle diameter of the suspended particles is 2.5 μm.

Separately, nitrogen is introduced in a separable flask, which is equipped with a stirrer, a thermometer, a condenser tube, and a nitrogen introduction tube, through the nitrogen introduction tube to convert the atmosphere in the flask to a nitrogen atmosphere. The thus-obtained suspension is put therein, and reacted at 65° C. for 3 hours. The resultant is further heated at 70° C. for 10 hours, and then cooled. The resultant reaction mixture is a dispersion, and no aggregate is visually observed during the polymerization.

A 10% hydrochloric acid aqueous solution is added to the reaction solution to decompose calcium carbonate, and then solid-liquid separation is performed by centrifugal separation. The obtained particles are washed with 1 L of ion-exchange water, and then washed by repeating three times 30 minute ultrasonic dispersion in 500 ml of ethanol and centrifugal separation, thereby obtaining a magnetic toner.

The magnetic toner is dried in a 60° C. oven, and is made to pass through a mesh having a pore diameter of 5 μm to separate coarse particles. Then, the number average particle diameter is measured and found to be 2.7 μm.

The amount of hydroxyl group in the magnetic toner is 0.6 mmol/g. The amount of hydroxyl group is measured as follows.

First, the magnetic toner is weighed and put in a test tube equipped with a cap. A given amount of a solution, which is prepared in advance by dissolving acetic anhydride (manufactured by Wako Pure Chemical Industries, Ltd.) in pyridine (manufactured by Wako Pure Chemical Industries, Ltd.), is put into the test tube, and the mixture is heated at 95° C. for 24 hours. Then, distilled water is added thereto to hydrolyze the acetic anhydride in the test tube. After that, the mixture in the test tube is subjected to centrifugal separation at 3,000 rpm for 5 minutes to separate it into particles and a supernatant. The polymer is washed with ethanol (manufactured by Wako Pure Chemical Industries, Inc.) by repeating ultrasonic dispersion and centrifugal separation. The supernatant and the liquid obtained after the washing are collected in a conical beaker. The collected liquid is subjected to titration with a 0.1 M potassium hydroxide ethanol solution (manufactured by Wako Pure Chemicals Industries, Inc.) using phenolphthalein (manufactured by Wako Pure Chemicals Industries, Inc.) as an indicator.

A blank test in which a polymer is not used is also conducted, and then the amount (mmol/g) of hydroxyl group is calculated from the difference in the amounts of the dripped potassium hydroxide ethanol solution which is used in the titration of the magnetic polymer particles of Example 1 and that of the blank test, in accordance with the following Equation (1).

$$\text{Amount of hydroxyl group} = ((B-C)\times 0.1\times f)/(w-(w\times D/100)) \quad \text{Equation (1):}$$

In Equation (1), B represents the amount (ml) of droplets in the blank test; C represents the amount (ml) of droplets in the sample; f represents a factor of the potassium hydroxide solution; w represents the weight (g) of particles; and D represents the amount (%) of the magnetic powder in the particles.

Preparation of Liquid Developer 5 parts of polyvinyl alcohol (PVA) (KURARAY POVAL 217 (registered name, manufactured by Kuraray Co., Ltd.); having a polymerization degree of 1,700 and a saponification degree of 88 mol %) are added to 95 parts of cooled ion-exchanged water, and dispersed by stirring with a magnetic stirrer, and further stirred and dissolved for 3 hours at 70° C. in a water bath, thereby preparing an aqueous PVA solution (PVA: 5%).

Magnetic toner: 5 parts

Aqueous PVA solution: 10 parts

Polyoxyethylene (20) cetyl ether (manufactured by Wako Pure Chemical Industries Ltd.): 0.5 part Ion exchange water: 84.5 parts The components described above are mixed, and dispersed with a ball mill for 3 hours, thereby preparing a liquid developer which includes the magnetic toner as a magnetic toner. 0.1 ml of the liquid developer is dispersed in 100 ml of a measurement liquid ISOTON (trade name, manufactured by BECKMAN COULTER Corp.). Then, the volume average particle diameter is determined with the COULTER COUNTER MULTISIZER 3 (trade name, manufactured by BECKMAN COULTER Corp.) and is found to be 5.0 μm.

Image Formation

An image forming apparatus 100 having the configuration shown in FIG. 1 is prepared, and the liquid developer thus obtained is used as a developer.

A magnetic drum 10 is prepared as follows: on an aluminum drum, Ni—P is plated to form an underlying layer having a thickness of 15 μm; Co—Ni—P is plated to form a magnetic recording layer having a thickness of 0.8 μm; and on the magnetic recording layer, a fluorine-containing lubricating plating is applied using Ni—P-PTFE particles to form a protective layer having a thicknesses of 1.5 μm. The magnetic recording layer has a coercive force of 400 Oe and a residual flux density of 7,000 G.

The contact angle at which pure water meets the surface of the magnetic drum 10 may be 110° at 25° C. and 50% RH.

As a magnetic head 12, a full-line magnetic head, which is capable of forming an image as fine as 600 dpi (dpi: number of dots per inch) and is composed of Mn—Zn ferrite, is prepared.

As a development device 14, a development device 14 is used which includes: an aluminum non-magnetic sleeve and a magnet roll in which cylindrical permanent magnets are concentrically arranged in the sleeve; and a stirring blade that stirs a liquid developer in the developer storage container 14*b*. The liquid developer is put in the developer storage container 14*b*, and the development device 14 is disposed in such a manner that a gap between the surface of the non-magnetic sleeve and the surface of the magnetic drum 10 is adjusted to 50 μm.

As the intermediate transfer member 16, an aluminum intermediate transfer drum is used which has a 7.5 mm-thick silicone rubber layer on the surface and rotates at the same peripheral speed as that of the magnetic drum 10. As the transfer-fixing roller 28, an elastic roller is used which includes a stainless-steel core and a silicone rubber layer and a fluoro-rubber layer which cover the core in this order. Furthermore, the elastic roller is configured so that the surface thereof is heated with a heating element to 170° C.

The image forming apparatus 100 having the above configuration is used, and printing conditions are set as follows.

Linear velocity of magnetic drum: 100 mm/sec

Ratio between circumferential velocity of development roller and circumferential velocity of magnetic drum (circumferential velocity of development roller/circumferential velocity of magnetic drum): 1.2

Transfer conditions (intermediate transfer conditions): Pressure applied to the magnetic drum from the intermediate transfer member is set to 0.147 MPa (1.5 kgf/cm$^2$)

Transfer and fixation conditions: Pressure of the transfer-fixing roller applied to the intermediate transfer member is set to 0.245 MPa (2.5 kgf/cm$^2$)

Under these conditions, a striped magnetic latent image (corresponding to half tone) having 30 μm-width stripes is formed on the magnetic drum 10 using the magnetic head 12, and the liquid developer is brought into contact with the magnetic drum by the development roller for development. Then, the developed toner image is transferred to the intermediate transfer member 16, and then transferred and fixed onto a recording sheet, thereby obtaining an image.

Evaluation

Color Development Properties of Image

Color development properties of an image are evaluated as follows. Color measurement is performed using a Spectrodensitometer X-rite 939 (trade name, manufactured by X-rite), and L*a*b* (L, a, b color) are determined. Then, a color difference ΔE from Japan color 2001 type 3 is determined, and used as an index of color development properties.

A: Less than 3

B: From 3 to less than 10

C: From 10 to less than 15

D: From 15 to less than 20

E: 20 or more

Evaluation of Development Properties

Development properties are evaluated as follows. The toner on the drum is transferred to a mending tape (manufactured by Sumitomo 3M Limited). The weight of the toner per unit area is weighed, and 4.5 g/m$^2$ is defined as a criterion for development properties.

A: 5.5 g/m$^2$ or more

B: From 4.5 to less than 5.5 g/m$^2$

C: From 3.5 to less than 4.5 g/m$^2$

D: Less than 3.5 g/m$^2$

The results are shown in Table 1.

In addition, regarding the image after development, the amount of the developed toner and the fine line reproducibility are confirmed using a laser microscope for ultra-depth examination (or an ultra-depth shape-measuring microscope; VK-9500 (trade name) manufactured by KEYENCE CORPORATION). As a result, each line of a toner image developed from a latent image has an average height of 4 μm and an average line width of 40 μm, which shows that the toner has sufficient development properties and resolution properties with respect to the magnetic latent image.

Moreover, an aqueous liquid in the liquid developer hardly adheres onto a region on the magnetic drum, in which no toner image has been formed, after development. As a result, adhesion of liquid is substantially not observed on the intermediate transfer drum or the sheet after fixation.

Furthermore, when the vicinity of the line of the image after fixation is observed under a microscope, fogging on a level causing an image problem is not observed.

The results confirm that when the water repellency of a liquid developer with respect to a magnetic drum is controlled, adhesion of water to the magnetic drum may be suppressed and an image can be obtained in which the generation of fogging is reduced owing to a magnetic toner having a small particle diameter.

Examples A1 to A5 and Comparative Example A2

Magnetic toners are produced and evaluated in the same manner as in Comparative Example A1, except that the amount of the magnetic powder of Comparative Example A1 is changed in accordance with Table 1. The results are shown in Table 1.

TABLE 1

| | Magnetic powder Amount (volume %) | Color development property | Development property |
|---|---|---|---|
| Comparative Example A1 | 0.1 | A | D |
| Example A1 | 0.2 | B | C |
| Example A2 | 0.5 | B | B |
| Example A3 | 1.0 | B | B |
| Example A4 | 2.0 | C | B |
| Example A5 | 5.0 | D | A |
| Comparative Example A2 | 7.0 | E | A |

Example B

Example B1

A magnetic toner is produced in the same manner as in Example A1, except that the magnetic powder of Example A1 is changed to nickel powder. Nickel powder has a lower magnetization per unit weight as compared with that of iron magnetic powder (iron powder). Therefore, with the same amount as in Example A1, the nickel powder does not function as a magnetic toner. In order for the nickel powder to function as a magnetic toner having the same level as that of Example A1, a large amount of nickel powder is required to be blended in a toner. As a result, the percentage that nickel powder prevents transmission of light increased, and the color enhancement properties are remarkably reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to persons skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer, comprising:

an aqueous medium; and a magnetic toner which is substantially dispersed in the aqueous medium and includes a polymer compound and a magnetic powder, the amount of the magnetic powder being from about 0.2 volume % to about 5 volume % with respect to the magnetic toner.

2. The liquid developer according to claim 1, wherein the magnetic powder has a magnetization in a magnetic field of 40 kA/m of from about $7.2\times10^{-4}$ wb/m$^2$ to about 0.0178 wb/m$^2$.

3. The liquid developer according to claim 1, wherein the magnetic powder is an iron magnetic powder.

4. The liquid developer according to claim 1, wherein the surface of the magnetic powder is subjected to hydrophobic treatment.

5. The liquid developer according to claim 1, wherein the polymer compound is a polymer comprising ethylenically unsaturated monomers including a hydroxyl group-containing monomer and a hydrophobic monomer.

6. The liquid developer according to claim 5, wherein the amount of the hydroxyl group of the polymer is from about 0.1 mmol/g to about 5.0 mmol/g.

7. The liquid developer according to claim 5, wherein the ethylenically unsaturated monomers further include a monomer having a carboxyl group.

8. The liquid developer according to claim 1, wherein the number average particle diameter of the magnetic toner is from about 0.1 μm to about 20 μm.

9. A process cartridge, comprising:

a magnetic latent image holder;

a developer storing unit that stores the liquid developer according to claim 1; and a developer supply device that supplies the liquid developer to the magnetic latent image holder on which a magnetic latent image has been formed.

10. The process cartridge according to claim 9, wherein the surface of the magnetic latent image holder has water repellency.

11. The process cartridge according to claim 9, further comprising a stirrer in the developer storing unit.

12. The process cartridge according to claim 9, further comprising a regulation device that maintains the film thickness of the liquid developer at a certain thickness.

13. An image forming apparatus, comprising:

a magnetic latent image holder;

a magnetic latent image forming device that forms a magnetic latent image on the magnetic latent image holder;

a developer storing unit that stores the liquid developer according to claim 1;

a developer supply device that supplies the liquid developer to the magnetic latent image holder on which the magnetic latent image has been formed so as to visualize the magnetic latent image as a toner image;

a transfer member that transfers the toner image to a recording medium; and a demagnetizer that demagnetizes the magnetic latent image on the magnetic latent image holder.

14. The image forming apparatus according to claim 13, wherein the surface of the magnetic latent image holder has water repellency.

15. The image forming apparatus according to claim 13, further comprising a stirrer in the developer storing unit.

16. The image forming apparatus according to claim 13, further comprising a regulation device that maintains the film thickness of the liquid developer at a certain thickness.

* * * * *